US007090766B2

(12) United States Patent
Johnson et al.

(10) Patent No.: US 7,090,766 B2
(45) Date of Patent: Aug. 15, 2006

(54) PROCESS FOR ULTRA LOW SULFUR GASOLINE

(76) Inventors: Kenneth H. Johnson, P.O. Box 630708, Houston, TX (US) 77263; Richard L. Moseley, P.O. Box 630708, Houston, TX (US) 77263

( * ) Notice: Subject to any disclaimer, the term of this patent is extended or adjusted under 35 U.S.C. 154(b) by 580 days.

(21) Appl. No.: 10/260,989

(22) Filed: Sep. 30, 2002

(65) Prior Publication Data

US 2003/0230516 A1 Dec. 18, 2003

Related U.S. Application Data

(60) Provisional application No. 60/329,487, filed on Oct. 16, 2001.

(51) Int. Cl.

| | |
|---|---|
| ***C10G 45/02*** | (2006.01) |
| ***C10G 65/04*** | (2006.01) |
| ***C10G 45/32*** | (2006.01) |

(52) U.S. Cl. ..... 208/210; 208/208 R; 208/209; 208/211; 208/218; 208/213; 208/143; 585/259; 585/260; 585/264; 203/DIG. 6

(58) Field of Classification Search ..... 208/218, 208/208 R, 209, 210, 211, 213, 143; 585/259, 585/260, 264; 203/DIG. 6

See application file for complete search history.

(56) References Cited

U.S. PATENT DOCUMENTS

| | | | | |
|---|---|---|---|---|
| 5,308,471 A | | 5/1994 | Apelian et al. | 208/89 |
| 5,346,609 A | | 9/1994 | Fletcher et al. | 208/89 |
| 5,399,258 A | | 3/1995 | Fletcher et al. | 208/89 |
| 5,409,596 A | | 4/1995 | Fletcher et al. | 208/89 |
| 5,413,697 A | | 5/1995 | Fletcher et al. | 208/89 |
| 5,510,106 A | | 4/1996 | Yamamoto et al. | 424/207.1 |
| 5,597,476 A | * | 1/1997 | Hearn et al. | 208/208 R |
| 6,495,030 B1 | * | 12/2002 | Podrebarac | 208/218 |

OTHER PUBLICATIONS

Syed A. Ali & Jamal A. Anabtawi, Olefins can limit desulfurization of reformer, Oil & Gas Journal, pp. 48–54, Jul., 1995.

D.P. Satchell & Bil. Crynes, High olefins content may limit cracket naphtha desulfurization, Oil & Gas Journal, pp. 123–124, Dec., 1975.

* cited by examiner

*Primary Examiner*—Tam M. Nguyen
(74) *Attorney, Agent, or Firm*—Kenneth H. Johnson; Richard L. Moseley

(57) ABSTRACT

A process wherein all of the unsaturates within a cracked naphtha stream are substantially hydrogenated to alkanes and the olefin depleted stream is then subjected to hydrodesulfurization to achieve the desired sulfur levels without the formation of recombinant mercaptans.

6 Claims, 3 Drawing Sheets

PROCESS FOR ULTRA LOW SULFUR GASOLINE

This application claims the benefit of U.S. Provisional Application No. 60/329,487, filed on Oct. 16, 2001.

BACKGROUND OF THE INVENTION

1. Field of the Invention

The present invention relates to the production of very low sulfur content gasoline. More particularly the invention relates to a process for the production of very low sulfur gasoline from naphtha stocks containing significant amounts of unsaturated compounds including olefins, diolefins and acetylenes.

2. Related Information

Governments worldwide are requiring lower and lower organic sulfur contents in motor gasolines because of the noxious sulfur oxides which are produced in their combustion. The United States is expected to lower its limits on total organic sulfur contents to less than 50 weight parts per million.

This requirement comes on the heels of government requirements for cleaner burning fuels containing more oxygenated compounds such as ethers or alcohols.

Octane, the index of how well a gasoline performs in an internal combustion, is always a much sought after characteristic. The basis for measuring octane is a comparison to 2,2,4 trimethyl pentane (isooctane) whose octane number is 100. Other hydrocarbons which exhibit a good octane number are aromatics and olefins. Of the aromatics, benzene, because of its known carcinogenic properties, is not desirable as a gasoline component.

Petroleum distillate streams contain a variety of organic chemical components. Generally the streams are defined by their boiling ranges which determines the composition. The processing of the streams also affects the composition. For instance, products from either catalytic cracking or thermal cracking processes contain high concentrations of olefinic materials as well as saturated (alkanes) materials and polyunsaturated materials (diolefins). Additionally, these components may be any of the various isomers of the compounds.

The composition of untreated naphtha as it comes from the crude still, or straight run naphtha, is primarily influenced by the crude source. Naphthas from paraffinic crude sources have more saturated straight chain or cyclic compounds. As a general rule, most of the "sweet" (low sulfur) crudes and naphthas are paraffinic. The naphthenic crudes contain more unsaturates and cyclic and polycylic compounds. The higher sulfur content crudes tend to be naphthenic. Treatment of the different straight run naphthas may be slightly different depending upon their composition due to crude source.

Reformed naphtha or reformate generally requires no further treatment except perhaps distillation or solvent extraction for valuable aromatic product removal. Reformed naphthas have essentially no sulfur contaminants due to the severity of their pretreatment for the process and the process itself.

Cracked naphtha as it comes from the catalytic cracker has a relatively high octane number as a result of the olefinic and aromatic compounds contained therein. In some cases this fraction may contribute as much as half of the gasoline in the refinery pool together with a significant portion of the octane.

Catalytically cracked naphtha gasoline boiling range material currently forms a significant part (≈⅓) of the gasoline product pool in the United States and it provides the largest portion of the sulfur. The sulfur impurities may require removal, usually by hydrotreating, in order to comply with product specifications or to ensure compliance with environmental regulations. Some users require the sulfur of the final product to be below 50 wppm.

The most common method of removal of the sulfur compounds is by hydrodesulfurization (HDS) in which the petroleum distillate is passed over a solid particulate catalyst comprising a hydrogenation metal supported on an alumina base. Additionally copious quantities of hydrogen are included in the feed. The following equations illustrate the reactions in a typical HDS unit:

$$RSH+H_2 \rightarrow RH+H_2S \quad (1)$$

$$RCl+H_2 \rightarrow RH+HCl \quad (2)$$

$$2RN+4H_2 \rightarrow 2RH+2NH_3 \quad (3)$$

$$ROOH+2H_2 \rightarrow RH+2H_2O \quad (4)$$

Typical operating conditions for the HDS reactions are:

| | |
|---|---|
| Temperature, ° F. | 600–780 |
| Pressure, psig | 600–3000 |
| $H_2$ recycle rate, SCF/bbl | 1500–3000 |
| Fresh $H_2$ makeup, SCF/bbl | 700–1000 |

After the hydrotreating is complete the product may be fractionated or simply flashed to release the hydrogen sulfide and collect the now desulfurized naphtha. The loss of olefins by incidental hydrogenation has been considered detrimental due to the reduction of the octane rating of the naphtha and the reduction in the pool of olefins for other uses.

However, it has been found that $H_2S$ recombines with olefins in a naphtha to produce mercaptans. These recombinant mercaptans make it difficult to achieve the lower sulfur levels being required.

At one time it was thought necessary to "reform" heavy fluid cracked naphtha. The reforming process requires that sulfur and nitrogen contaminants be almost nonexistent, that is, less than 0.5 weight parts per million. In addition olefins caused coking of the reforming catalysts and thus the content was required to be less than one percent by volume. Generally only straight run naphthas had been fed to reformers contained little if any olefinic compounds and sulfur compounds which were easily removed. The traditional reformer pretreatment hydrotreaters were satisfactory for the earlier reformer feeds. However, the heavy fluid cracked naphthas required severe treating conditions to remove the sulfur, nitrogen and olefin contaminants to the desired levels. Pressures in excess of 1100 psig (hydrogen partial pressures of greater than 600 psia) and temperatures above 650° F. were necessary. In the end the high severity of treating and lowering of projected octane requirements made this process neither feasible nor necessary.

SUMMARY OF THE INVENTION

Briefly the present invention comprises a process wherein all of the unsaturates within a cracked naphtha stream are substantially hydrogenated to alkanes and the olefin depleted stream is then subjected to hydrodesulfurization to achieve the desired sulfur levels. The effluent from the process may be further processed to improve its octane by standard reforming or isomerization.

Either or both of the hydrogenation and desulfurization processes are preferably carried out in distillation column reactors wherein distillation is occurring simultaneously with reaction. The catalyst for each process may be in the form to act as both catalyst and distillation structure, or may be contained within a distillation structure. As used herein the term "distillation column reactor" means a distillation column which also contains catalyst such that reaction and distillation are going on concurrently in the column (in a reaction distillation zone). In a preferred embodiment the catalyst is prepared as a distillation structure and serves as both the catalyst and distillation structure.

If the effluent is to be upgraded by reforming, the hexanes (particularly the isohexanes) should be removed to prevent formation of benzene in the reformer. This can be done in the hydrodesulfurization distillation column reactor with the hexanes being taken overheads or as a side stream.

DETAILED DESCRIPTION OF THE INVENTION

Figure 1:
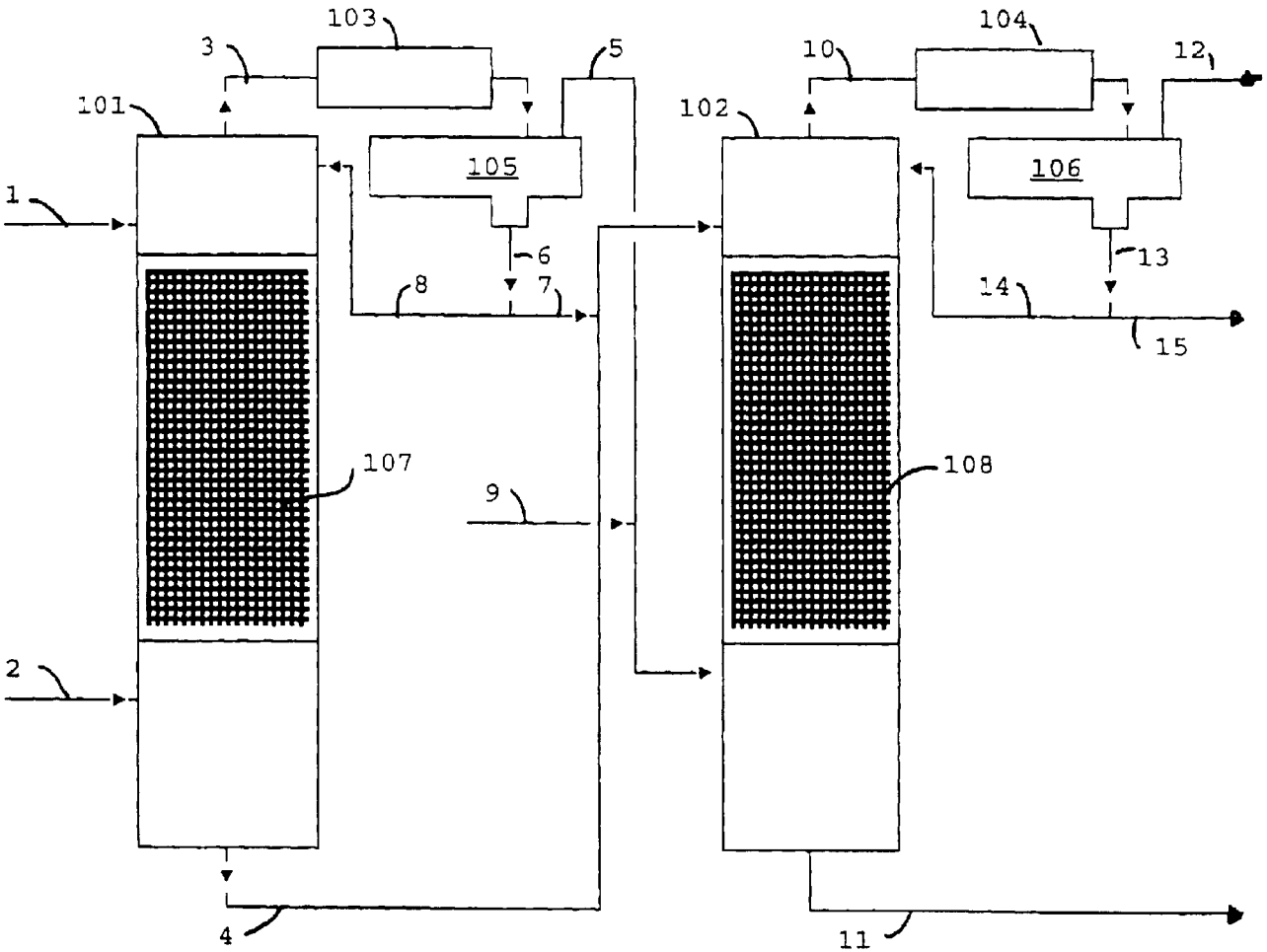
FIG. 1 is a simplified flow diagram of one embodiment of the invention.

The feed to the process comprises a sulfur-containing petroleum fraction from a fluidized bed catalytic cracking unit (FCCU) which boils in the gasoline boiling range ($C_5$ to 420° F.). Generally the process is useful on the naphtha boiling range material from catalytic cracker products because they contain both olefins and unwanted sulfur compounds. Straight run naphthas have very little olefinic material, and unless the crude source is "sour", very little sulfur.

The sulfur content of the catalytically cracked fractions will depend upon the sulfur content of the feed to the cracker as well as the boiling range of the selected fraction used as feed to the process. Lighter fractions will have lower sulfur contents than higher boiling fractions. The sulfur components in the front end (lower boiling fraction) are mainly mercaptans and typical of those compounds are: methyl mercaptan (b.p. 43° F.), ethyl mercaptan (b.p. 99° F.), n-propyl mercaptan (b.p. 154° F.), iso-propyl mercaptan (b.p. 135–140° F.), iso-butyl mercaptan (b.p. 190° F.), tert-butyl mercaptan (b.p. 147° F.), n-butyl mercaptan (b.p. 208° F.), sec-butyl mercaptan (b.p. 203° F.), iso-amyl mercaptan (b.p. 250° F.), n-amyl mercaptan (b.p. 259° F.), α-methylbutyl mercaptan (b.p. 234° F.), α-ethylpropyl mercaptan (b.p. 293° F.), n-hexyl mercaptan (b.p. 304° F.), 2-mercapto hexane (b.p. 284° F.), and 3-mercapto hexane (b.p. 135° F.). Typical sulfur compounds found in the heavier boiling fraction include the heavier mercaptans, thiophenes sulfides and disulfides. A full boiling range fluid cracked naphtha will thus contain a wide variety of sulfur compounds.

The unsaturated compounds within a cracked naphtha stream include olefins, diolefins, and acetylenic compounds. These compounds can comprise up to 20 percent of the cracked naphtha.

Catalysts

Catalysts which are useful in either of the reactions utilized in the invention include the Group VIII metals. Generally the metals are deposited as the oxides on an alumina support. In the first reactor the catalysts are characterized as hydrogenation catalysts. The preferred catalyst for the hydrogenation reaction is palladium oxide supported on alumina. Typical physical and chemical properties of the catalyst as provided by the manufacturer are as follows:

TABLE I

| | |
|---|---|
| Designation | G68C |
| Form | Sphere |
| Nominal size | 5 × 8 mesh |
| Pd. wt % | 0.3 (0.27–0.33) |
| Support | High purity alumina |

In the second reactor, it is the purpose of the catalyst to destroy the sulfur compounds to produce a hydrocarbon stream containing $H_2S$ which is easily separated from the heavier components therein. The focus of the second column is to carry out destructive hydrogenation of the sulfides and other organic sulfur compounds. For this purpose hydrodesulfurization catalysts preferably comprise two metal oxides supported on an alumina base, wherein the metal oxides are chosen from the group consisting of molybdenum, cobalt, nickel, tungsten and mixtures thereof. More preferably cobalt modified with nickel, molybdenum, tungsten and mixtures thereof are the preferred catalysts.

The catalysts may be supported. The supports are usually small diameter extrudates or spheres. The catalysts are preferably prepared in the form of a catalytic distillation structure. The catalytic distillation structure must be able to function as catalyst and as mass transfer medium. The catalytic distillation structure must be suitably supported and spaced within the column to act as a catalytic distillation structure. Catalytic distillation structures useful for this purpose are disclosed in U.S. Pat. Nos. 4,731,229, 5,073,236, 5,431,890 and 5,266,546 which are incorporated by reference.

The properties of a typical hydrodesulfurization catalyst are shown in Table I below.

TABLE I

| Manufacture | Criterion | Criterion |
|---|---|---|
| Designation | C-448 | C-411SM3 |
| Form | Trilobe Extrudate | |
| Nominal size | 1.2 mm | 1.2 mm |
| Metal, Wt % | | |
| Cobalt | 2–5% | — |
| Molybdenum | 5–20% | 21.5% |
| Nickel | — | 3.5% |
| Support | alumina | alumina |

Process

The conditions suitable for the hydrogenation of substantially all of the unsaturated compounds in a distillation column reactor are considerably more severe than for selective hydrogenation of acetylenes and diolefins which has been practiced in the past. Hydrogen partial pressures in the range of 100–200 psia are anticipated. These hydrogen partial pressures are still considerably less than would be expected in standard downflow trickle bed reactors. The reaction temperature is that temperature where the material is boiling within the catalyst bed at the appropriate total pressure that yields the desired hydrogen partial pressure.

The conditions suitable for the desulfurization of naphtha in a distillation column reactor are very different than those in a standard trickle bed reactor, especially with regard to total pressure and hydrogen partial pressure. Typical conditions in a reaction distillation zone of a naphtha hydrodesulfurization distillation column reactor are:

| | |
|---|---|
| Temperature | 450–700° F. |
| Total Pressure | 75–300 psig |
| $H_2$ partial pressure | 6–75 psia |
| LHSV of naphtha | about 1–5 |
| $H_2$ rate | 0–1000 SCFB |

The operation of the distillation column reactor results in both a liquid and vapor phase within the distillation reaction zone. A considerable portion of the vapor is hydrogen while a portion is vaporous hydrocarbon from the petroleum fraction. Actual separation may be only a secondary consideration.

The result of the operation of the process in the distillation column reactor is that lower hydrogen partial pressures (and thus lower total pressures) may be used.

As in any distillation there is a temperature gradient within the distillation column reactor. The temperature at the lower end of the column contains higher boiling material and thus is at a higher temperature than the upper end of the column. The lower boiling fraction, which contains more easily removable sulfur compounds, is subjected to lower temperatures at the top of the column. The higher boiling portion is subjected to higher temperatures in the lower end of the distillation column reactor to crack open the sulfur containing ring compounds and hydrogenate the sulfur.

The present process reactions are preferably carried out in the distillation column reaction mode. Because the reaction is occurring concurrently with distillation, the initial reaction products and other stream components are removed from the reaction zone as quickly as possible reducing the likelihood of side reactions. Second, because all the components are boiling, the temperature of reaction is controlled by the boiling point of the mixture at the system pressure. The heat of reaction simply creates more boil up but no increase in temperature at a given pressure. As a result, a great deal of control over the rate of reaction can be achieved by regulating the system pressure. A further benefit that this reaction may gain from distillation column reactions is the washing effect that the internal reflux provides to the catalyst thereby reducing polymer build up and coking.

Finally, the upward flowing hydrogen acts as a stripping agent to help remove the $H_2S$ which is produced in the distillation reaction zone. However, either one or both of the reactions may be carried out in fixed bed single pass reactors or trickle bed reactors.

Referring now to FIG. 1 one embodiment of the present invention is shown. A full boiling range cracked naphtha is fed to the distillation column reactor 101 via flow line 1 above a bed 107 of hydrogenation catalyst. Hydrogen is fed to the distillation column reactor 101 below the bed 107 via flow line 2. The unsaturated compounds are reacted with hydrogen in bed 107 under conditions of temperature and pressure such that there are substantially no unsaturated compounds left (about 1 vol %). An overheads containing $C_5$'s and lighter and unreacted hydrogen is taken via flow line 3 and the condensible material condensed in partial condenser 103. The condensed material is collected and separated from the uncondensed material in receiver/separator 105. Hydrogen and other uncondensed gases are removed via flow line 5. Liquid overheads are withdrawn via flow line 6 with a portion being returned to the distillation column reactor 101 as reflux via flow line 8. A liquid product is withdrawn via flow line 7. A bottoms containing $C_6$ and heavier material is taken via flow line 4.

The bottoms and overhead liquid product are combined and fed to a second distillation column reactor 102 above a bed 108 of hydrodesulfurization catalyst. Hydrogen in flow line 5 is fed along with make up hydrogen in flow line 9 below the bed 108. In the bed 108 the organic sulfur compounds are reacted with hydrogen under conditions of temperature and pressure to produce $H_2S$ which is removed as overheads via flow line 10 along with a $C_5$ and lighter stream and unreacted hydrogen. And condensible material is condensed in partial condenser 104. The condensed material is collected and separated from the gases in receiver/separator 106. Hydrogen and $H_2S$ are vented via flow line 12. If desired the $H_2S$ may be removed from the gas and the hydrogen recirculated. A stabilized (no $C_5$ and lighter) naphtha product is removed as bottoms via flow line 11. The stabilized product may be fed to an isomerization unit or reforming unit for octane upgrading.

If desired the two distillation columns 101 and 102 may be combined into one with either dual beds of catalyst or a single bed of a suitable catalyst such as an alumina supported nickel molybdenum catalyst.

Figure 2:
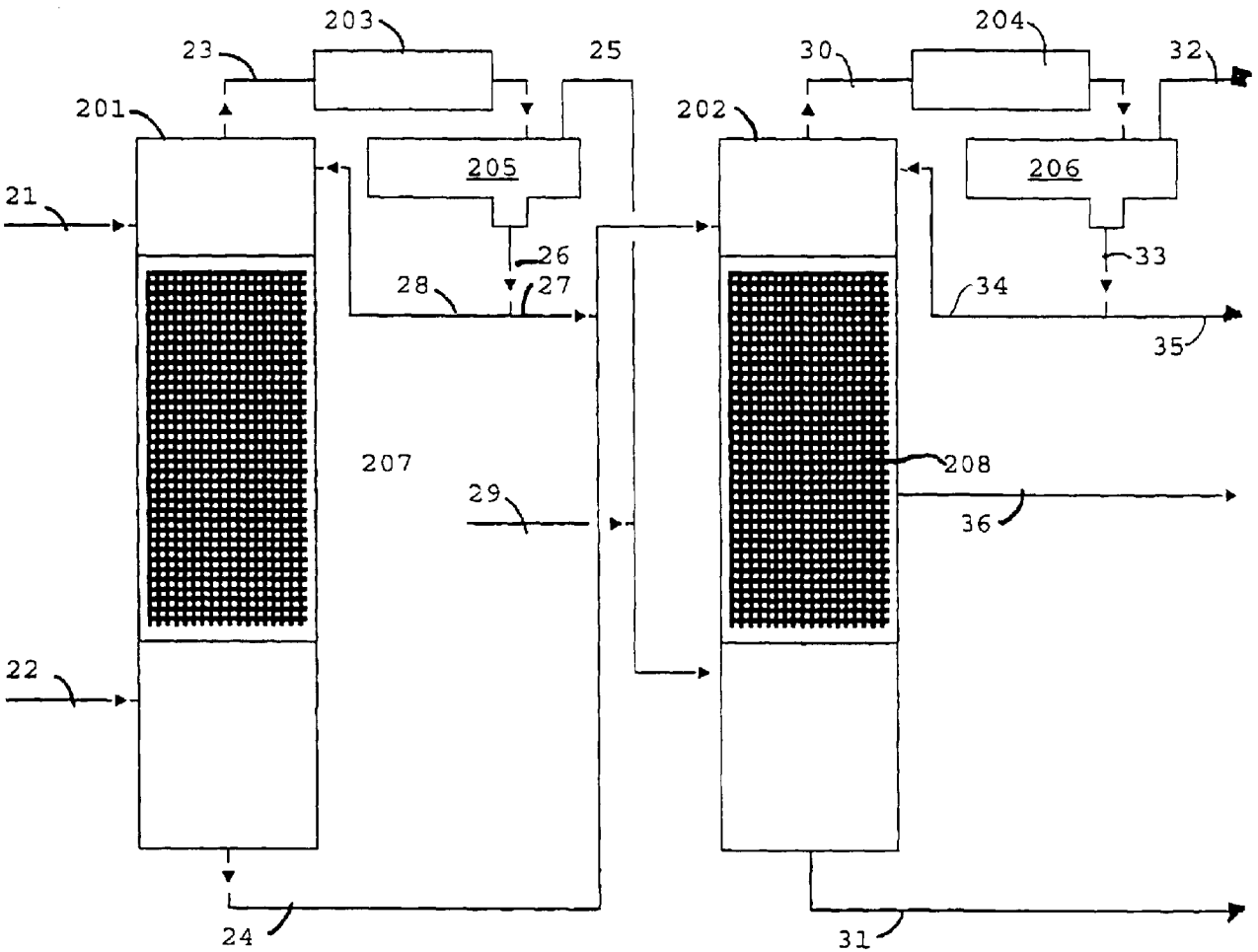
FIG. 2 is a simplified flow diagram of a second embodiment of the invention.

If benzene in gasoline is a problem then the $C_6$'s can be removed from the stabilized product prior to feeding to the reformer. This is shown in FIG. 2, an alternate embodiment of the invention. Again, a full boiling range cracked naphtha is fed to the distillation column reactor 201 via flow line 21 above a bed 207 of hydrogenation catalyst. Hydrogen is fed to the distillation column reactor 201 below the bed 207 via flow line 22. The unsaturated compounds are reacted with hydrogen in bed 207 such that there are substantially no unsaturated compounds left (about 1 vol %). An overheads containing $C_5$'s and lighter and unreacted hydrogen is taken via flow line 23 and the condensible material condensed in partial condenser 203. The condensed material is collected and separated from the uncondensed material in receiver/separator 205. Hydrogen and other uncondensed gases are removed via flow line 25. Liquid overheads are withdrawn via flow line 26 with a portion being returned to the distillation column reactor 101 as reflux via flow line 28. A liquid product is withdrawn via flow line 27. A bottoms containing $C_6$ and heavier material is taken via flow line 42.

The bottoms and overhead liquid product are combined and fed to a second distillation column reactor 202 above a bed 208 of hydrodesulfurization catalyst. Hydrogen in flow line 25 is fed along with make up hydrogen in flow line 29 below the bed 208. In the bed 208 the organic sulfur compounds are reacted with hydrogen under conditions of temperature and pressure to produce $H_2S$ which is removed as overheads via flow line 30 along with a $C_5$ and lighter stream and unreacted hydrogen. And condensible material is condensed in partial condenser 204. The condensed material is collected and separated from the gases in receiver/separator 206. Hydrogen and $H_2S$ are vented via flow line 32. If desired the $H_2S$ may be removed from the gas and the hydrogen recirculated. A side stream containing the $C_6$ boiling range material is removed via flow line 36. A stabilized (no $C_6$ and lighter) naphtha product is removed as bottoms via flow line 31. The stabilized product may be fed to reforming unit for octane upgrading and no benzene will be produced.

Again, if desired, the two distillation columns 201 and 202 may be combined into one with either dual beds of catalyst or a single bed of a suitable catalyst such as an alumina supported nickel molybdenum catalyst.

Figure 3:
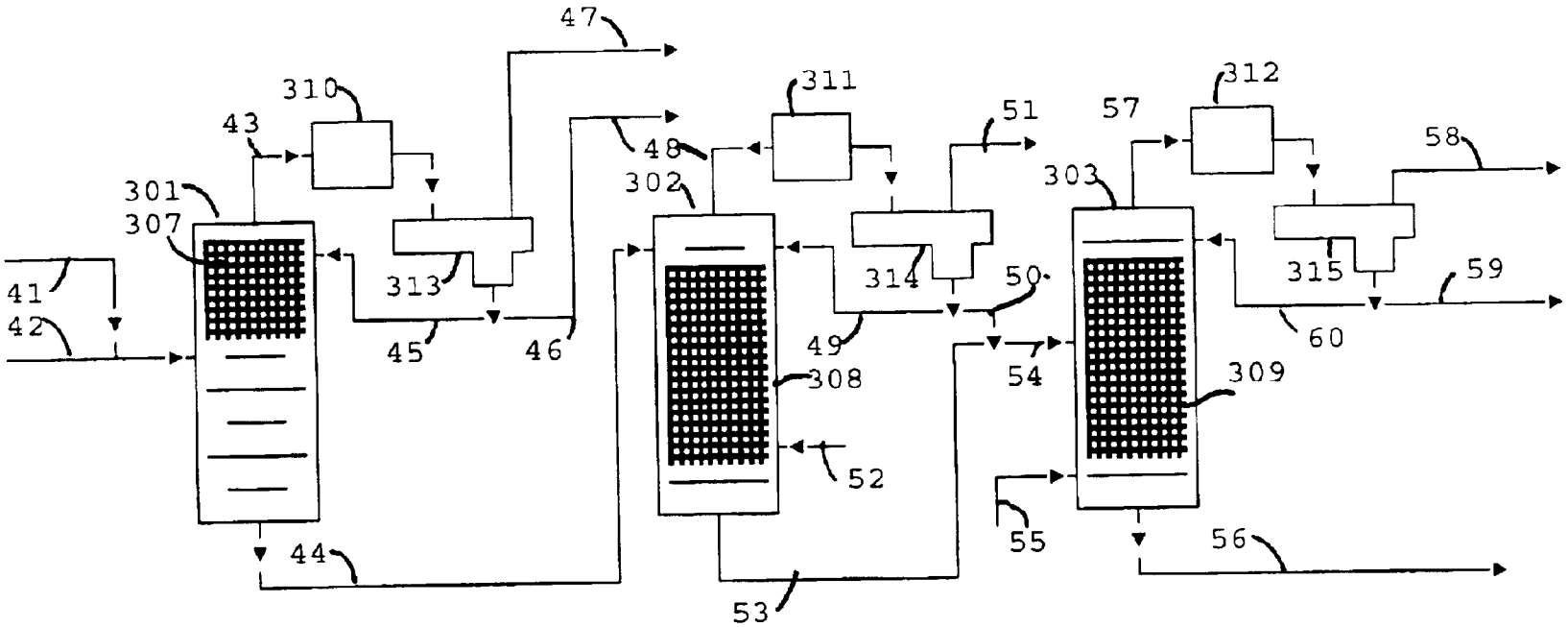
FIG. 3 is a simplified flow diagram of a third embodiment of the invention.

If it is desired to preserve the lower boiling olefins then a third embodiment of the invention may be utilized. This embodiment is shown in FIG. 3. In this embodiment the full boiling range naphtha is fed via flow line 42 to a first distillation column reactor 301 where it is split into a light fraction boiling between about 115–250° F. and a heavy fraction boiling between about 250–400° F. Hydrogen is fed via flow line 41. In the upper end of the distillation column reactor 301 is placed a bed 307 of palladium catalyst similar to that in the hydrogenation reactors above. The lower boiling fraction containing the desirable olefins and a large portion of the mercaptans is boiled upward into the bed under conditions of temperature and pressure where the diolefins contained in the naphtha react with the mercaptans to form higher boiling sulfides which are removed as bottoms along with the heavier naphtha via flow line 44.

The light naphtha is removed as overheads via flow line 43 and the condensibles condensed in condenser 310. Liquid is collected in receiver/separator 313 where the gases are vented via flow line 47. Liquid is withdrawn from the receiver/separator and a portion returned to distillation column reactor 301 as reflux via flow line 57. Liquid product is taken via flow line 46. If any mercaptans remain in the liquid product they can be removed by standard caustic wash methods, such as MEROX, which are known in the art.

The bottoms in flow line 44 are fed to a second distillation column reactor 302 above a bed 308 of hydrogenation catalyst. Hydrogen is fed below the bed 308 via flow line 52. The unsaturated compounds in the bottoms are reacted with hydrogen in bed 308 under conditions of temperature and pressure such that there are substantially no unsaturated compounds left (about 1 vol %). An overheads containing $C_6$'s and lighter and unreacted hydrogen is taken via flow line 48 and the condensible material condensed in partial condenser 311. The condensed material is collected and separated from the uncondensed material in receiver/separator 314. Hydrogen and other uncondensed gases are removed via flow line 51. Liquid overheads are withdrawn with a portion being returned to the distillation column reactor 302 as reflux via flow line 49. A liquid product is withdrawn via flow line 50. A bottoms containing $C_7$ and heavier material is taken via flow line 53.

The bottoms in flow line 53 and the liquid product in flow line 50 are combined in flow line 54 and fed to a third distillation column reactor 303 above a bed 309 of hydrodesulfurization catalyst. Hydrogen is fed below the bed 309 via flow line 53. The organic sulfur compounds in the feed are reacted with hydrogen in the bed under conditions of temperature and pressure to form $H_2S$ which is removed as overheads along with a $C_6$ and lighter fraction and unreacted hydrogen via flow line 47. The overheads are passed through partial condenser 312 where the condensible material is condensed. The condensed material is collected in receiver/separator 315 where the $H_2S$ and unreacted hydrogen are removed via flow line 58. Liquid is withdrawn and a portion is returned to the distillation column reactor 303 as reflux via flow line 60. Liquid product is taken via flow line 59. A $C_7$ and heavier bottoms is taken via flow line 56. The liquid products may be combined for further octane upgrading such as isomerization or reforming. If reforming is chosen and benzenes are not wanted the overheads containing the $C_6$'s are bypassed around the reformer.

As in the earlier described embodiments, the second and third distillation column reactors can be combined if desired.

The present invention will allow for total organic sulfur levels in the treated naphtha or gasoline to be 50 weight parts per million (wppm) or less.

What is claimed is:

1. A process for the production of low sulfur naphtha comprising the steps of:

(a) feeding hydrogen and a $C_5$ and heavier naphtha stream containing organic sulfur compound, olefins, diolefins and acetylenes to a first distillation column reactor containing a bed of hydrogenation catalyst;

(b) concurrently in said distillation column reactor
  (i) reacting the olefins, diolefins and acetylenes with hydrogen under conditions of temperature and pressure to produce saturated compounds and
  (ii) separating a $C_5$ and lighter stream and unreacted hydrogen from the $C_6$ and heavier material by fractional distillation;

(c) withdrawing the $C_5$ and lighter stream from the first distillation column reactor as a first overheads (d) condensing the $C_5$ material in said overheads;

(e) withdrawing a $C_6$ and heavier material from the first distillation column reactor as a first bottoms;

(f) feeding said first bottoms and said condensed $C_5$ material along with hydrogen to a second distillation column reactor above a bed of hydrodesulfurization catalyst;

(g) concurrently in said second distillation column reactor
  (i) reacting a portion of the organic sulfur compounds contained within said first bottoms and said condensed $C_5$ material with hydrogen under conditions of temperature and pressure to produce $H_2S$; and
  (ii) separating a $C_5$ and lighter stream, $H_2S$ and unreacted hydrogen from the $C_6$ and heavier material by fractional distillation;

(h) removing said $C_5$ and lighter stream, $H_2S$ and unreacted hydrogen from said second distillation column reactor as a second overheads;

(i) removing a $C_6$ and heavier material from said second distillation column reactor as a second bottoms, said second bottoms containing less organic sulfur compounds than said naphtha feed.

2. The process according to claim 1 wherein a $C_6$ stream is taken from said second distillation column reactor as a side stream and said second bottoms contains $C_7$ and heavier material.

3. The process according to claim 1 wherein said second bottoms is fed to an isomerization process for octane upgrading.

4. The process according to claim 1 wherein said second bottoms is fed to a reforming process for octane upgrading.

5. The process according to claim 2 wherein said second bottoms is fed to a reforming process for octane upgrading.

6. The process according to claim 1 wherein a portion of said condensed $C_5$ material is returned to said first distillation column reactor as reflux.

* * * * *